US012637921B2

(12) United States Patent
Murphy et al.

(10) Patent No.: US 12,637,921 B2
(45) Date of Patent: May 26, 2026

(54) WELLBORE BEAM SPRING TRAVEL LIMITER

(71) Applicant: Halliburton Energy Services, Inc., Houston, TX (US)

(72) Inventors: Robert Travis Murphy, Carrollton, TX (US); Samuel Martinez, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/786,138

(22) Filed: Jul. 26, 2024

(65) Prior Publication Data

US 2025/0290384 A1 Sep. 18, 2025

Related U.S. Application Data

(60) Provisional application No. 63/566,750, filed on Mar. 18, 2024.

(51) Int. Cl.
*E21B 33/12* (2006.01)
*E21B 33/129* (2006.01)

(52) U.S. Cl.
CPC ..... *E21B 33/1208* (2013.01); *E21B 33/1293* (2013.01)

(58) Field of Classification Search
CPC . E21B 33/1208; E21B 33/1293; E21B 43/127
See application file for complete search history.

(56) References Cited

U.S. PATENT DOCUMENTS

| | | | | |
|---|---|---|---|---|
| 6,772,836 | B2 | 8/2004 | Schetky et al. | |
| 2005/0230100 | A1 | 10/2005 | Hirth et al. | |
| 2008/0296845 | A1 | 12/2008 | Doane | |
| 2011/0155471 | A1 | 6/2011 | Wolfer | |
| 2015/0315864 | A1* | 11/2015 | Patton | E21B 23/0411 166/382 |
| 2019/0003287 | A1* | 1/2019 | MacDonald | E21B 23/00 |
| 2020/0048982 | A1 | 2/2020 | Krueger et al. | |
| 2022/0259934 | A1* | 8/2022 | Wood | E21B 33/1292 |

FOREIGN PATENT DOCUMENTS

| | | |
|---|---|---|
| EP | 3137723 | 12/2022 |
| WO | 2015175409 | 11/2015 |

OTHER PUBLICATIONS

"PCT Application No. PCT/US24/42179 International Search Report and Written Opinion", Dec. 10, 2024, 11 pages.
"NL 2039402 Search Report", Jul. 24, 2025, 8 pages.

* cited by examiner

*Primary Examiner* — David Carroll
(74) *Attorney, Agent, or Firm* — DeLizio, Peacock, Lewin & Guerra LLP

(57) ABSTRACT

Some implementations include an apparatus comprising a finned insert configured for placement within at least a portion of an inner circumference of a slotted compressible tubular, the finned insert having a plurality of fins, wherein each fin of the plurality of fins is configured to fit within a slot of the slotted compressible tubular.

20 Claims, 10 Drawing Sheets

WELLBORE BEAM SPRING TRAVEL LIMITER

BACKGROUND

Sealing sleeves, sealing elements, packers, liner hangers, tubing hangers, liner top packers, etc. may be used to seal a work string against an inner surface of a larger diameter tubular. For example, a tubing hanger used in an oil & gas well may use a plurality of anchoring spikes, sealing rings/sleeves, etc. to sealingly engage with a larger diameter casing string. However, maintaining this seal in varying temperature conditions may prove challenging due to the shrinking and expansion of materials when subject to temperature variations. Therefore, a device may be included along the work string that assists in maintaining the seal over a broad range of temperatures and temperature fluctuations.

For example, a beam spring may be included along the work string to maintain axial compression on one or more sealing rings/sleeves, to minimize an axial force exerted on the work string via the setting of a hanger, to reduce backlash between a sealing element and an interior surface of the casing, etc. The beam spring may be a tubular including a plurality of slots cut or otherwise machined into its body. The slots may give the beam spring a degree of compressibility. The beam spring may be configured to compress under axial load. However, over-stress of the beam spring in compression may exceed its yield strength, causing the beam spring to plasticly deform. This may reduce its effectiveness when used downhole.

BRIEF DESCRIPTION OF THE DRAWINGS

Implementations of the disclosure may be better understood by referencing the accompanying drawings.

FIGS. 1-10 and the operations described herein are examples meant to aid in understanding example implementations and should not be used to limit the potential implementations or limit the scope of the claims. None of the implementations described herein may be performed exclusively in the human mind nor exclusively using pencil and paper. None of the implementations described herein may be performed without computerized components such as those described herein. Some implementations may perform additional operations, fewer operations, operations in parallel or in a different order, and some operations differently.

DESCRIPTION

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Traditional beam springs may be used in place of belleville washers, wave-type spring designs, coil springs, etc. to prevent overstress in a work string. Traditional beam springs may use differing design configurations to achieve this. For example, traditional beam springs may enlarge a radius at the end of each slot, distributing the stress over a larger area. However, finite element analysis (FEA) and various testing techniques concluded this conventional approach did not preclude the over-stress of the beam springs. The enlarged radii may also fail to prevent spring yielding in high stress applications. Other traditional beam spring designs may use an internal sleeve within the beam spring or an external sleeve over the beam spring to prevent overstress. However, using the sleeve to prevent overstress in the beam spring may require the sleeve itself to be strong enough to handle the compression-stack load. At compressive loads which may be in excess of 500,000 pound-force (lbf), this configuration may not be feasible. When used with a downhole packer, an external sleeve used on a traditional beam spring may need to be keyed in order to alleviate concerns when milling the packer. The external sleeve may also use up too much cross-sectional area on the beam spring.

Therefore, a device configured to limit an axial travel of the beam spring and withstand the compressive forces exerted therein may aid in preventing beam spring overstress. Some example implementations may include using multiple thin finned inserts that are located inside the beam spring prior to assembly. These inserts may serve as spring travel limiters and fit inside the slots (milled, created via a water jet, etc.) of the beam spring. When the spring compresses, the thin finned members may prevent overstress of the spring. Only the fins may carry the compressive load through the spring "coil" thickness, so the compression load path may be similar if not identical to that of the beam spring itself. Utilizing the beam spring and finned inserts with downhole packers, liner hangers, tubing hangers, and other downhole tools may increase the tools' performance in low-temperature and large temperature delta ($\Delta T$) environments.

Example System

Figure 1:
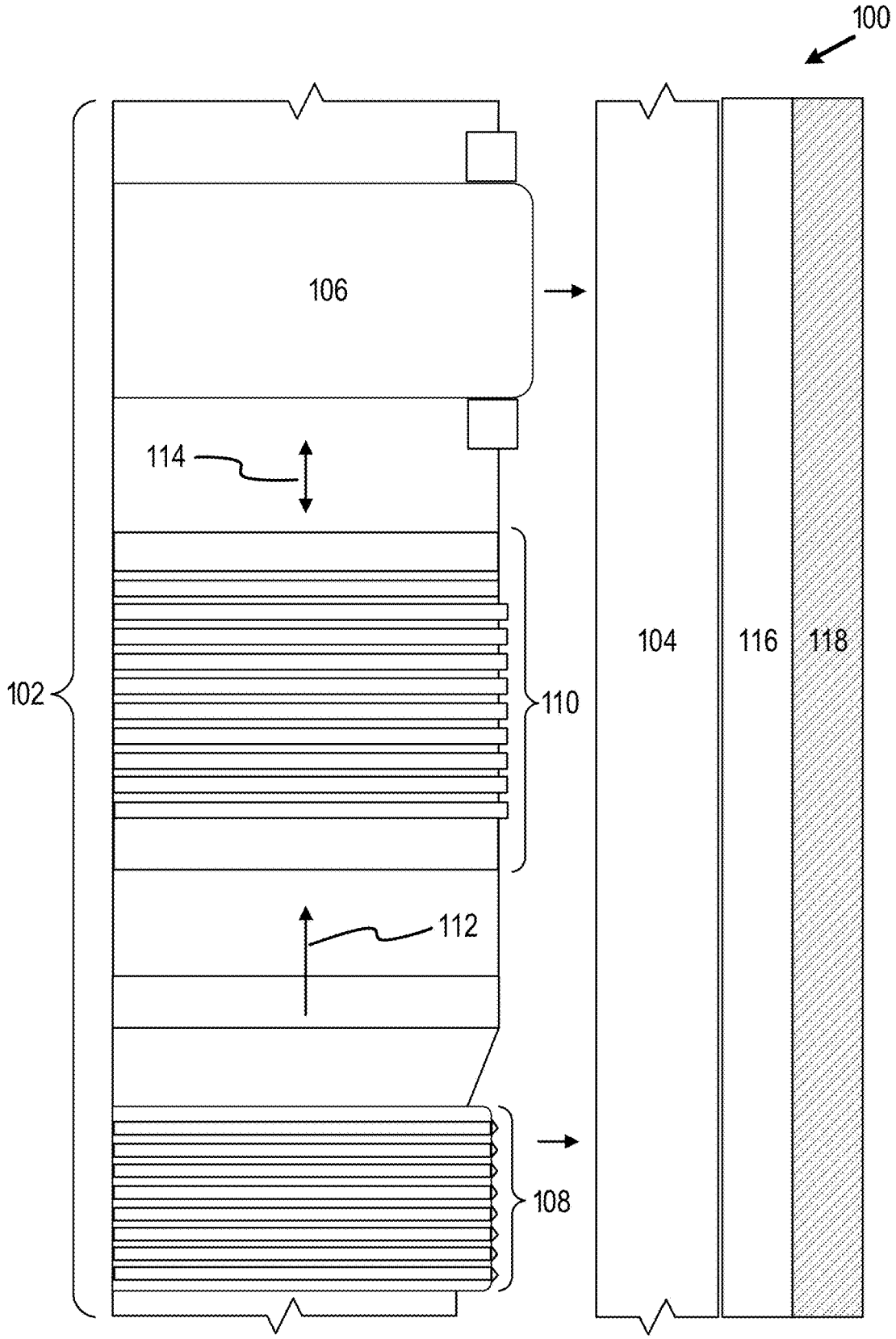
FIG. 1 is a perspective view depicting an exterior of a packer configured for use with a beam spring, according to some implementations.

An example wellbore system having a beam spring is now described. FIG. 1 is a perspective view depicting an exterior of a packer configured for use with a beam spring, according to some implementations. In FIG. 1, at least a portion of a wellbore 100 extends through a subsurface formation 118. The perspective of FIG. 1 may depict a longitudinal view of half of the wellbore 100. In the wellbore 100, a work string 102 may include an external slip section 108, an element package 106, and a beam spring 110. While a single external slip section 108 and element package 106 are depicted, varying quantities may be used.

While the beam spring 110 may generally be deployed to downhole systems utilizing a packer or a tubing hanger, other tool configurations may be possible. For example, some implementations of the work string 102 may include a liner hanger, casing hanger, one or more sealing sleeves, sealing elements, a liner top packer, and any other downhole tool(s) configured to form a seal between an outer surface of a first tubular and an inner surface of a second tubular. Sizing of the various components of the work string 102 and distances between them may be exaggerated for purposes of depiction in FIG. 1; differing sizes and distances between components may be possible. Some implementations of the work string 102, such as the tubing hanger configuration, may not include the element package 106.

Continuing the above example, the work string 102 may be configured to form a seal with an inner surface of a wall of a tubular 104. In some implementations, the tubular 104 may be a casing string cemented in the wellbore 100 via cement 116. However, other scenarios may be possible. Mechanical actuation, hydraulic actuation, etc. may extend the external slip section 108 towards the tubular 104 until contact is made. The external slip section 108 may include a plurality of anchoring spikes, slips, ratcheting mechanisms, other mechanical sealing devices, etc. configured to form a mechanical seal with the tubular 104. For example, the external slip section may include one or more external slips including teeth, wickers, or similar abrasive structures on their exterior. The teeth of the slips may be positioned to penetrate, grip, and/or bite into the inner surface of the tubular 104 (e.g., a section of casing) so as to transfer mechanical loads from the work string 102 into the tubular 104. The mechanical loads may be induced via axial travel of the work string 102, other axial forces, downhole pressure, etc. This may form a mechanical seal that anchors the work string 102 (e.g., a tubing string) in place within the wellbore 100.

When the external slip section 108 has formed the mechanical seal and is fixed in place, an axial load 112 from the weight of the work string 102 may navigate up the work string through the beam spring 110 and element package 106. The axial load 112 may cause the element package 106 to compress and radially expand until a pressure seal is formed between the work string 102 and tubular 104. Whereas the external slip section 108 and mechanical seal formed therewith may be configured to anchor the work string 102 to the tubular 104, the element package 106 may form the pressure seal. The pressure seal may contribute to zonal isolation by isolating pressure and fluids above and below the element package 106. Some implementations of the element package 106 may be comprised of an elastomer such as Tetrafluoroethylene Propylene (FEPM), although other materials may be used.

A beam spring such as the beam spring 110 may be defined as a tubular member that has been weakened via the removal of material (i.e., by saw blade, water jetting, wire electrical discharge machining (wire EDM), etc.) to create slots in the tubular member, the slots granting the tubular member the ability to compress in on itself. Beam springs may typically be comprised of one solid piece of material which includes many slots cut therein that enable the spring to compress. The beam spring may typically be a high compressive load-handling (e.g., in excess of 500,000 lbf), short travel cylinder with slots cut therein perpendicular to the axis of travel, although other configurations may be possible. Beam springs such as the beam spring 110 may always be loaded in compression.

The beam spring 110 may be used to maintain energization on the element package 106 during thermal cycles. For example, the element package 106 may be comprised of an elastomer that may undergo thermal contraction upon a temperature drop in the wellbore 100. The thermal contraction may cause a reduction in volume of the clement package 106 without externally applied stresses to maintain its activation. Therefore, while the external slip section 108 may be "fixed" in place and anchored to the tubular 104 during thermal cycles, the element package 106 may lose its scaling capability upon thermal contraction. The beam spring 110 may apply an axial force 114 to the element package 106 to allow the element package to pack off and maintain the seal with the tubular 104. Thus, even though the element package 106 may experience axial and longitudinal shrinkage during thermal contraction, the beam spring 110 may supply enough force to axially energize the element package 106. This axial energization, via the axial force 114, may cause the clement package to bulge and maintain a radial squeeze on an inner surface of the tubular 104. The beam spring 110 may therefore allow the element package 106 to operate over its entire operating temperature range. Without the beam spring 110 to counteract the thermal contraction, this may not be possible.

In one example, some implementations of the work string 102 may include a packer. The packer may be set at a downhole temperature of 500° F. and expected to operate over a range of 100° F.-550° F. It may be difficult to maintain energization of the packer over the 450° F. temperature delta ($\Delta T$). Beam springs such as the beam spring 110 may enable the packer (or similar sealing device such as the element package 106) to maintain energization and continue sealing against the tubular 104 across its entire operating temperature range. The beam spring 110 may expand a thermal operating range of one or more components of the work string 102, particularly in cooling environments where components may experience thermal contraction. However, some implementations of the beam spring 110 may be used in other scenarios. For example, the beam spring 110 may be deployed for use in carbon dioxide ($CO_2$) injection operations. Large thermal swings may occur in the wellbore 100 upon the initiation and halting of fluid injection.

In some implementations, a beam spring with thinner slots and configured for reduced compression may be used in thermal warming cycles. For example, a packer may be set within the wellbore 100 at 100° F. The beam spring 110 in this example may be configured to not fully compress upon the expected stresses downhole. At a downhole temperature of 500° F. within the wellbore 100, one or more sealing surfaces of the packer may expand and generate an axial force 114 downward towards the beam spring 110 and external slip section 108. In this configuration, the beam spring 110 may still have room to expand to accommodate the thermal expansion of the elements.

Some implementations of the beam spring 110 may be used to reduce backlash when setting a tool such as a tubing hanger in the wellbore 100. Backlash may refer to a clearance or lost motion in a mechanism caused by one or more gaps between its parts. A minor amount of backlash may always be present, but it may be beneficial to minimize backlash in precise mechanical systems and systems used to generate downhole seals. In some implementations, the beam spring 110 may be used in place of an element package on a tubing hanger. Instead, the external slip section 108 may include one or more slips that are activated and set into the tubular 104 (which may be a joint of casing). However, other slips and/or anchoring devices may be used. The beam spring 110 may be used to provide relief for backlash of one or more threads, ratcheting mechanisms, etc. when setting the hanger. An inner member of the hanger may move towards the slips to set the slips into the tubular 104, whereas an outer member of the hanger may move in the opposite direction toward the beam spring 110. The beam spring may absorb some of the shock during the set and help reduce backlash along the hanger assembly—thereby, the slips may always be energized with tubular 104. The beam spring 110 may be used to absorb some of the shock during setting and may reduce backlash so the slips of the hanger may remain energized into the casing. Other implementations of the beam spring 110 may be positioned between a ratcheting mechanism and an element package of a packer of the work string 102. The ratcheting mechanism may be configured to catch early movement in the setting process of the packer, and the element package may include an elastomeric sealing material. Thus, various configurations of the beam spring 110 may be used to energize backlash within a mechanical system of the work string 102 or to energize the element package 106 (e.g., of a packer) against thermal contraction over a range of temperatures.

Example Beam Springs and Finned Inserts

Figure 2:
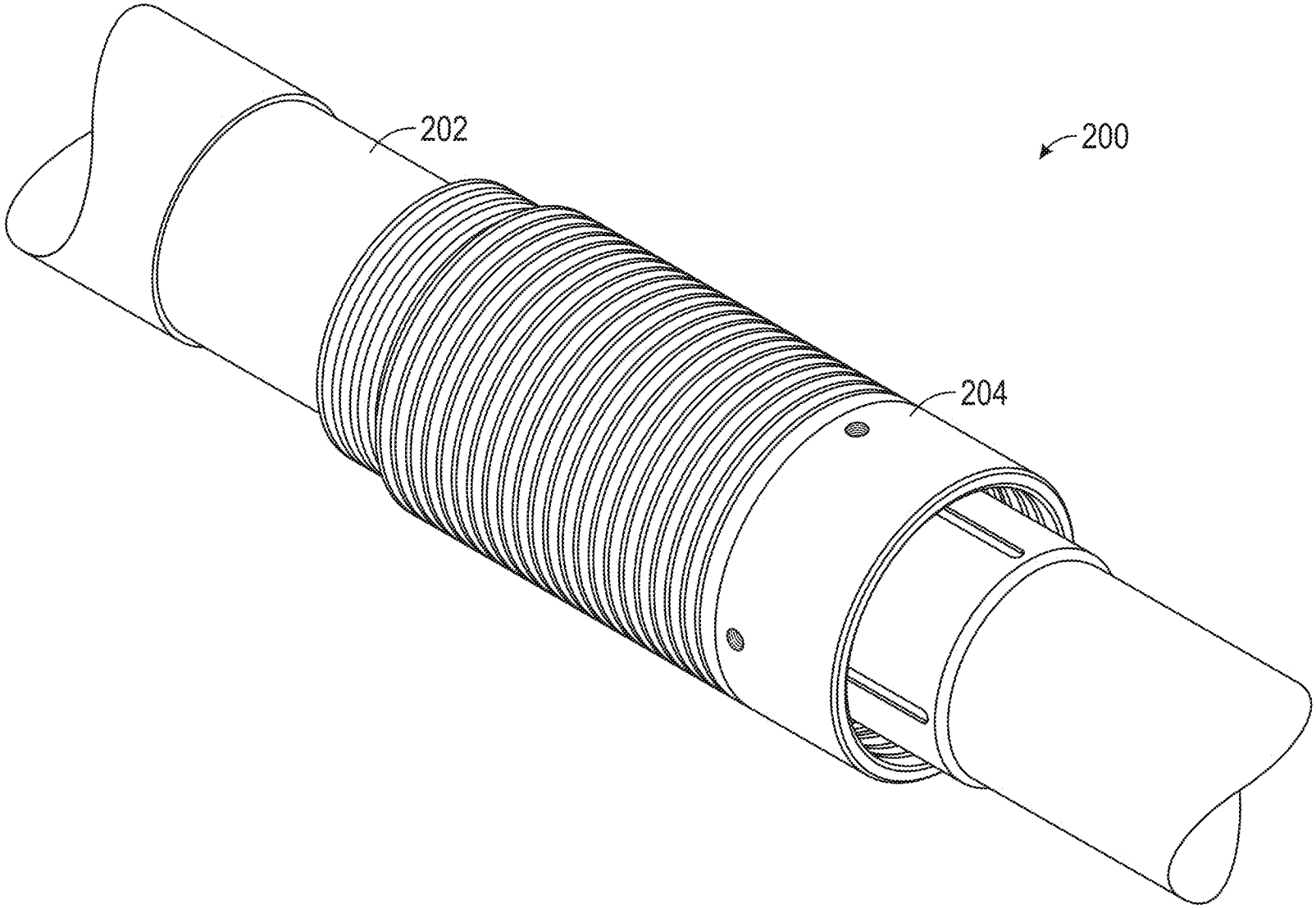
FIG. 2 is a perspective view depicting an example assembly including a beam spring, according to some implementations.

An example beam spring is now described. FIG. 2 is a perspective view depicting an example assembly including a beam spring, according to some implementations. In particular, FIG. 2 depicts an assembly 200 including a mandrel 202 and a beam spring 204. The beam spring 204 may be similar to the beam spring 110 of FIG. 1. In some implementations, the mandrel 202 may be a section of the work string 102.

The beam spring 204 may be a cylinder including a plurality of slots machined or cut into the body of the beam spring. Sections of the slots may be created at different timings. The slot timing may refer to a spacing between the slots and an offset of the slots. The different slot timings may allow the beam spring 204 to compress under large compressive loads without yielding in similar fashion to a coil spring. The slots and a travel limiting device used within is described with additional detail in FIG. 3.

Figure 3:
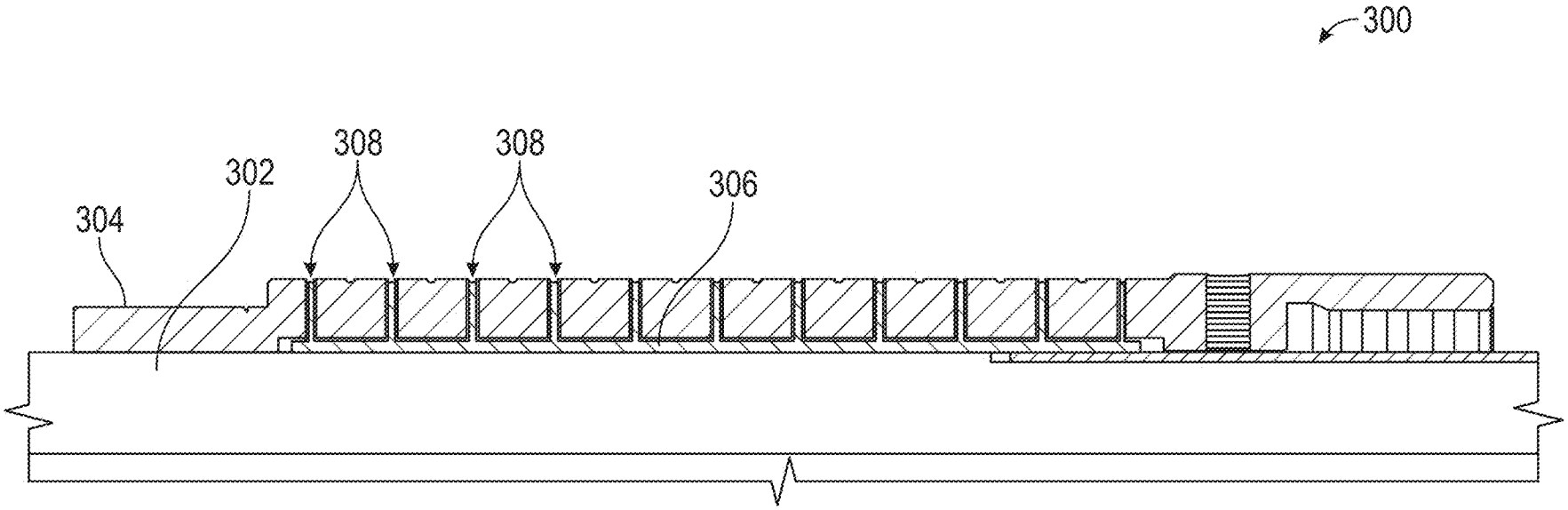
FIG. 3 is a longitudinal section depicting the example beam spring and an example finned insert, according to some implementations.

FIG. 3 is a longitudinal section 300 depicting the example beam spring and an example finned insert, according to some implementations. In particular, FIG. 3 depicts a mandrel 302 and a beam spring 304. The beam spring 304 may include a finned insert 306 having a base and a plurality of fins configured to fit within one or more slots 308.

The finned insert 306 may be used as a travel limiter for the beam spring 304. Traditional beam springs may use an internal or external sleeve to limit an axial travel of the beam spring, reduce the compressive load on the beam spring, avoid exceeding the yield strength of the beam spring, etc. However, these sleeves may be designed with thick walls to support the compressive forces from a downhole work string. The wall thickness may cause the work string to have a larger outer diameter, and the sleeves may prove problematic during milling. For example, an external sleeve may rotate independent of other outer-diameter components such as the example beam spring.

The finned insert 306 may not induce issues during downhole milling or increase an outer diameter (OD) of the beam spring 304. The finned insert 306 may be created to fit within an interior of the slots 308 of the beam spring 304. The finned insert 306 may be manufactured via one or more processes including additive manufacturing, machining, 3D printing, wire EDM, etc. In some implementations, a timing, a phasing, etc. of the finned insert 306 may be created as needed via additive manufacturing. Phasing may refer to a radial angular orientation of the finned inserts when looking at a cross-section of the beam spring 304. For example, inserts having a 180° phasing may include two outward-facing inserts on opposing sides of a beam spring. Inserts having a 60° phasing may refer to six inserts positioned along a circumference of the beam spring, each insert facing 60° away from its neighbors. A timing of the fins may refer to a spacing between each of the fins and an offset of all of the fins. An example finned insert may include fins of a similar spacing to the slots 308, but the fins may not fit into the slots if they are offset at a different timing.

The beam spring 304 may be generated from a single cylinder of material, and two or more of the finned inserts 306 may be manually positioned within an interior of the beam spring. Each finned insert may only fit a portion of the circumference of the inner surface of the beam spring 304, and multiple inserts may be used. The inner diameter of the beam spring 304 may not allow substantial clearance for placement of a single, full-circumference finned insert. However, in some implementations, the beam spring 304 and finned insert 306 may both be created via additive manufacturing. Additive manufacturing may enable the creation of a two-piece component including the beam spring 304 and a full-circumference, full-length finned insert 306.

Some implementations of the beam spring 304 and finned insert 306 may be comprised of the same material, whereas other implementations of the beam spring 304 and finned insert 306 may be comprised of differing materials. Typically, the beam spring 304 and finned insert 306 may be comprised of one or more corrosion-resistant metals or metal alloys such as low-alloy steel, aluminum, etc. For example, the beam spring 304 and finned insert 306 may be comprised of steel alloyed with one or more elements such as titanium, molybdenum, manganese, nickel, chromium, vanadium, silicon, boron, etc. The beam spring 304 may be comprised of a higher yield strength material than the finned insert 306, such as a higher-grade steel. The finned insert 306 may only be loaded in compression and may not always experience load, so the finned insert 306 may instead be comprised from more economical materials including lower-cost steel, alloys, and composites than the beam spring 304.

Some implementations of the finned insert 306 may be comprised of a composite material configured to handle large compressive loads in excess of hundreds of thousands of pounds. General composites may creep and extrude under the high compressive loads in the wellbore 100, but some reinforced composites may resist extrusion under large compressive loads. For example, the finned insert 306 may be comprised of a carbon woven composite having a compressive strength of 1-3 gigapascals (GPa), which may be equal to approximately 435,000 $lbf/in^2$. Other implementations of the finned insert 306 may be comprised of other composites including glass-filled nylon, glass-filled Teflon (PTFE), fiber-reinforced elastomers, etc. that may not extrude or creep under the expected compressive loads downhole. A finned insert 306 comprised of a composite material may be manufactured via forming, extrusion molding, injection molding, etc. in addition to the above-described manufacturing techniques.

Figure 4:
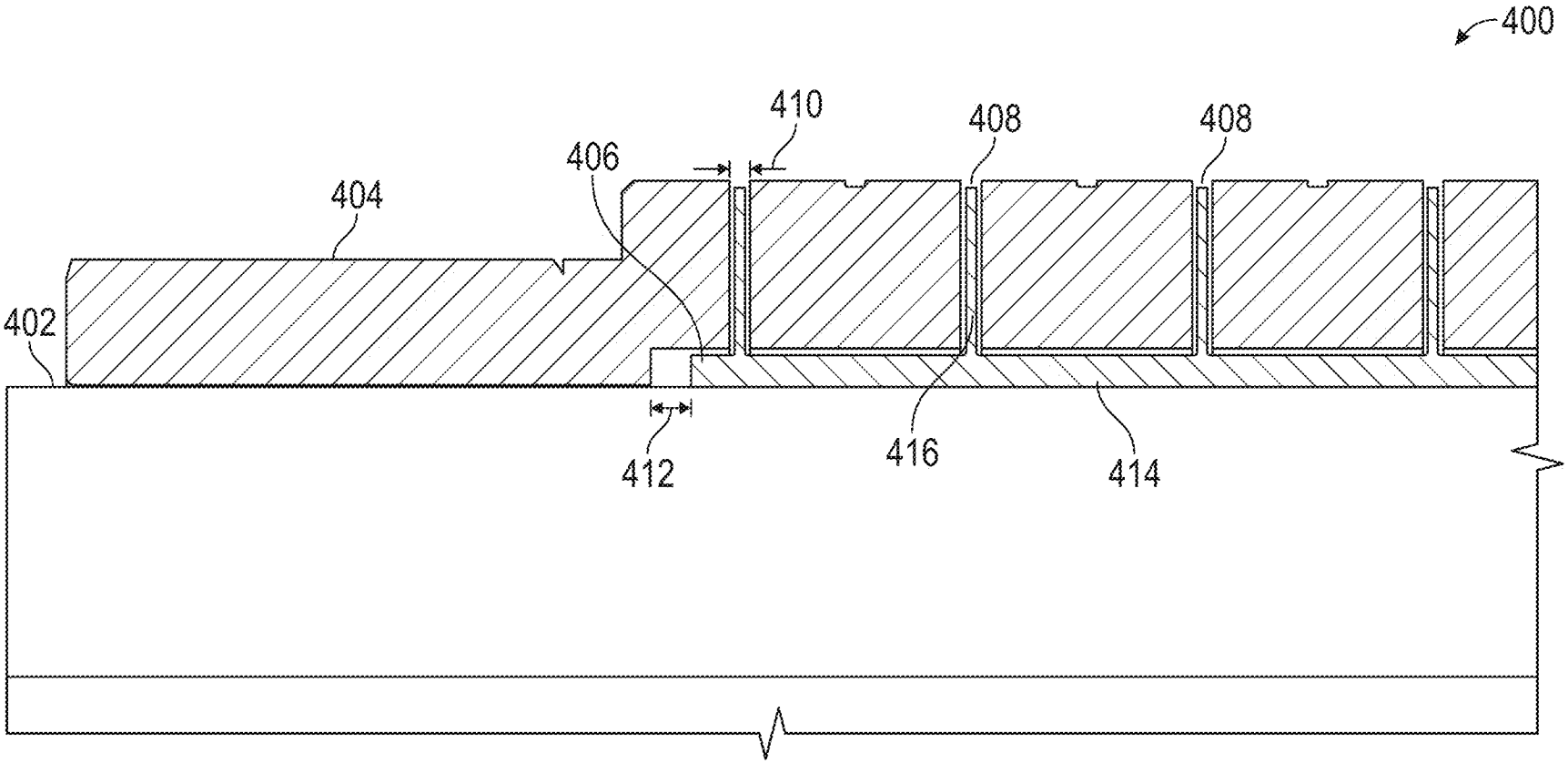
FIG. 4 is a more detailed longitudinal section of FIG. 3, according to some implementations.

FIG. 4 is a more detailed longitudinal section 400 of FIG. 3, according to some implementations. Particularly, the longitudinal section 400 depicts a mandrel 402, a beam spring 404, and a finned insert 406 which may be similar to the mandrel 302, beam spring 304, and finned insert 306 of FIG. 3. The beam spring 404 may include a plurality of slots 408 each having a gap width 410. The beam spring 404 may include a spacer gap 412 on either side of the finned insert 406 (only one side is shown). In some implementations, the inner diameter (ID) of the beam spring 404 may be larger under the slots 408. Traditional springs may not include this larger ID, but the beam spring 404 may include this ID expansion to accommodate the finned insert 406. As seen in the longitudinal section 400, the finned insert 406 may fit into this portion of the beam spring 404 and not radially extend into the ID of the mandrel 402.

The finned insert 406 may include a plurality of fins 416 each thinner than a gap width 410 of their respective slot. Each fin 416 of the finned insert 406 may be configured to have a fin width less than that of the gap width 410. This may allow the beam spring 404 to axially compress into the fins—if the fins were to fill the entirety of the gap width 410, it may inhibit the beam spring's compressibility. In some implementations, the fins 416 may be of a height equal to or shorter than the height of its respective slot. However, other dimensions may be possible.

The fins 416 may be configured to support an axial force exerted on the beam spring 404 under compression. To avoid spring yielding, the fins 416 may each be configured to limit the axial travel of the beam spring 404. By mechanically limiting the maximum deflection or compression that the beam spring 404 may experience, the fins 416 may help the beam spring 404 remain within its elastic range and avoid reaching the yield strength. In some implementations, the fin widths may be tuned such that the beam spring 404 reaches a predetermined percentage of its yield strength upon compression.

Computer modeling techniques such as finite element analysis (FEA) may be used to determine stress concentrations of the beam spring 404, although other techniques may be used. For example, FEA may be used to simulate a compression of the beam spring 404 at both ends without the finned insert 406. Stresses may accumulate at specific points along the beam spring 404. For example, stress concentrations may occur at top and bottom ends of the slots 408. Modeling may be used to determine an axial displacement at which the yield strength of the beam spring 404 at the ends of the slots 408 (points of stress concentration) is exceeded. For example, at this point of axial displacement, a compressed gap width may be equal to 0.02 in. The original gap width 410 may be 0.05 in; therefore, the beam spring 404 may have a maximum allowable axial displacement of 0.03 in before its yield strength is exceeded. Therefore, the fins 416 of the finned insert 406 may be larger than the maximum allowable axial displacement of the beam spring 404 under compression. In this example, each fin 416 may have a width of 0.035 in, although other widths may be used. The stress that may be experienced at the ends of the slots 408 may therefore be limited with the inclusion of the finned insert 406. Therefore, an optimized spring compression based on fin thickness may be determined to prevent over stress/over travel of the beam spring 404. This also means that the overall spring length may be optimized for a desired amount of elastic compression, which may reduce costs during design phases and reduce a number of spring design iterations.

The fin thickness of each fin 416 may be tuned prior to manufacturing the finned insert 406 based on a desired beam spring performance. In some implementations, the desired beam spring performance may be determined via modeling. For example, the finned insert 406 may be created in such a fashion to maintain elastic deformation (and avoid plastic deformation) of the beam spring 404 upon compression. A plastically-deformed beam spring that has been compressed beyond its yield strength may not return to its original shape, and this may reduce its functionality in energizing one or more components of a work string downhole.

The thickness of the fins 416 may be tuned based on the gap width 410. The gap width 410 may also be adjusted during the manufacturing of the beam spring 404. For example, slimmer gap widths may result in a stiffer, less compressible, smaller axial displacement beam spring 404. The width of the fins 416 may be adjusted to accommodate the altered gap width. In some implementations, each fin 416 of the finned insert 406 may have a substantially identical thicknesses at each slot 408. In some implementations, a substantially identical thickness may be a difference in thickness of less than 0.1%, less than 1%, less than 2%, less than 3%, less than 4%, less than 5%, less than 10%, etc. However, some implementations may use different fin thicknesses and gap widths. For example, the beam spring 404 may be designed with fin thicknesses that gradually increment along a length of the beam spring 404. The fin thicknesses may progressively thicken or thin along the length of the beam spring 404. This may be referred to as a progressive rate spring.

The spacer gap 412 may be included between the body of the beam spring 404 and a base 414 of the finned insert 406. The spacer gap 412 may be sized based on the empty space not occupied by the fins 416 across each gap width 410. In some implementations, the spacer gap 412 may be configured to be larger than the cumulative spacing between the fins 416 and beam spring 404 across all gap widths 410 along the beam spring 404. This cumulative spacing may be a sum of unoccupied space not filled by a fin 416 across all gap widths 410. In some implementations, each slot may include a gap width of 0.06 in, although other gap widths may be possible.

In contrast to traditional beam spring travel limiters, the finned insert 406 may include the base 414 that may act as a carrier for the fins 416. The base 414 may not be load-bearing, but the base 414 may have the benefit of being slimmer than traditional internal sleeves. The spacer gap 412 may ensure that an axial load path travels across the beam spring 404 and fins 416—not the base 414. Upon compression of the beam spring 404, the spacer gap 412 may still retain free space to avoid applying axial stresses to the base 414.

Figure 5:
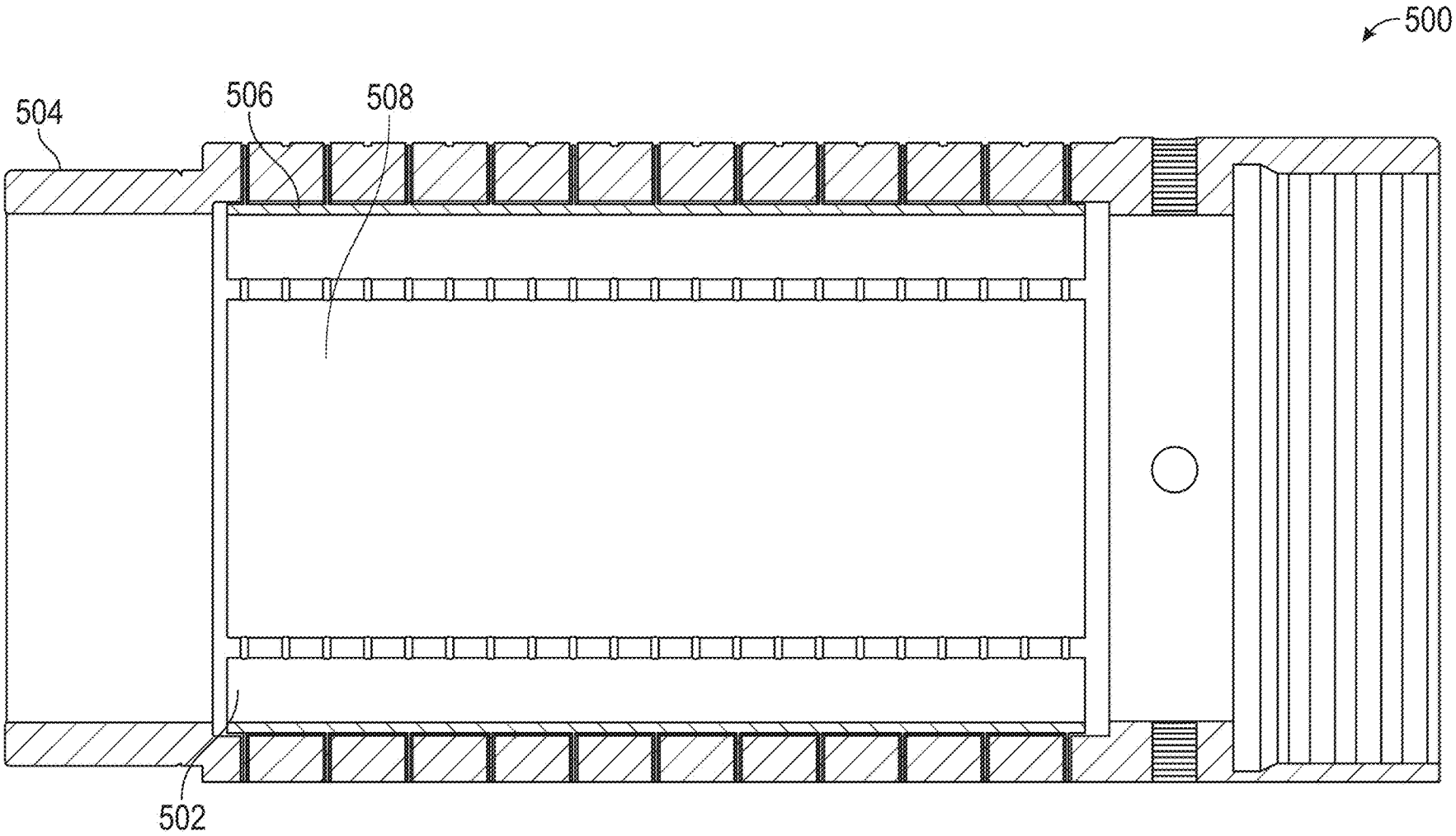
FIG. 5 is a longitudinal section of the example assembly of FIG. 2 with multiple inserts, according to some implementations.

FIG. 5 is a longitudinal section 500 of the example assembly of FIG. 2 with multiple inserts, according to some implementations. The longitudinal section 500 may include a beam spring 504, a first finned insert 502, a second finned insert 508, and a third finned insert 506. Other quantities of the finned inserts 502, 506, 508, etc. may be used. The beam spring 504 may be similar to the beam spring 404 of FIG. 4. The first finned insert 502 and third finned insert 506 may be similar to the finned insert 406. The first finned insert 502 and third finned insert 506 may be offset by a phasing of 180°, although other phasings and quantities of inserts may be possible. A desired phasing may be selected by an operator or a user. The fins of the inserts 502 and 506 may be keyed to slots of similar timings. However, the second finned insert 508 may include fins keyed to a different slot timing (differing spacing, offset, etc.) relative to the inserts 502, 506. In some implementations, the inserts 502, 506, and 508 may span a compressible portion (having slots) of the beam spring 504. However, in other implementations, each finned insert may only span a portion of the length of the compressible portion of the beam spring 504. For example, two finned inserts each spanning 50% of the slots may be used in place of the second finned insert 508. Other configurations may be possible.

Figure 6:
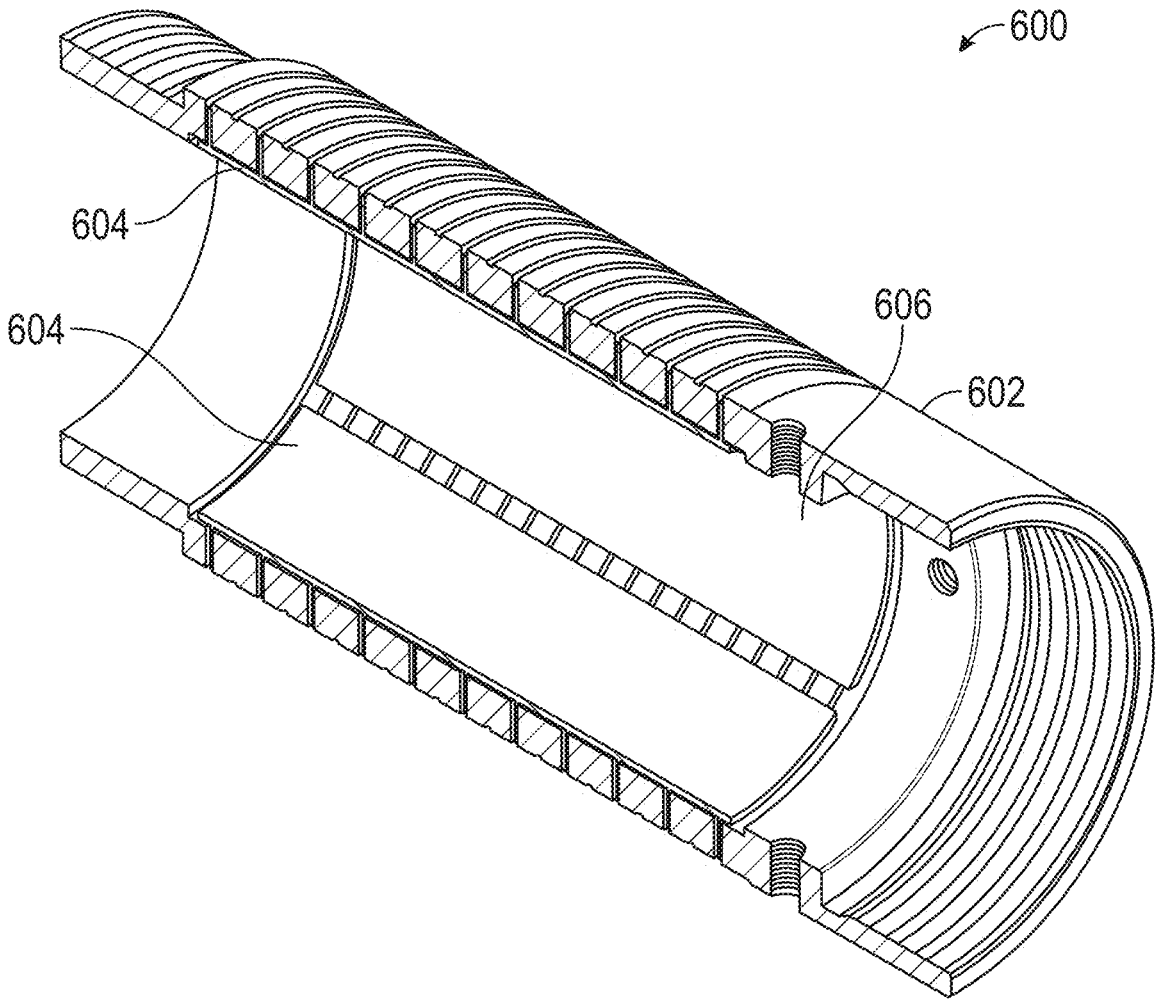
FIG. 6 is an isometric view of the example assembly of FIG. 5, according to some implementations.

FIG. 6 is an isometric view 600 of the example assembly of FIG. 5, according to some implementations. Similar to FIG. 5, the isometric view 600 depicts a first pair of finned inserts 604, a second finned insert 606 (paired with an insert not in view), and a beam spring 602. The inserts 604 and 606 may include a curved base to fit into the slots of the beam spring 602. While the finned inserts 604-606 are depicted as having a 180° phasing, other configurations may be possible.

Figure 7:
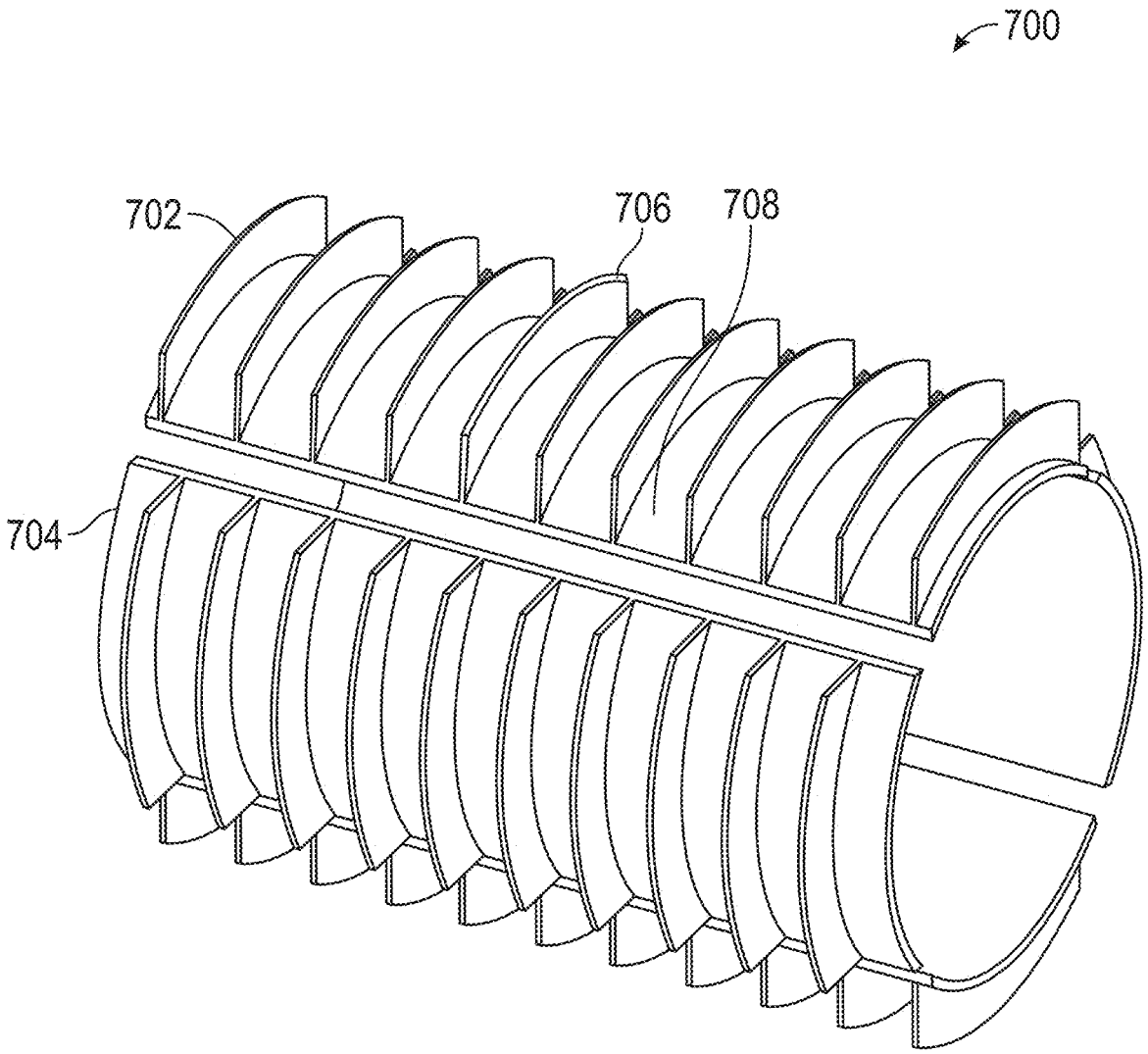
FIG. 7 is an illustration depicting a full insert configuration, according to some implementations.

FIG. 7 is an illustration 700 depicting a full insert configuration, according to some implementations. As depicted, a finned insert 702 and a second finned insert 704 may be paired with opposing finned inserts of identical slot timings. However, other phasings and slot timings may be possible. In some implementations, a single finned insert may be created (e.g., via additive manufacturing) to accommodate all slot timings across an example beam spring.

Each of the finned inserts 702, 704 may include a plurality of fins 706. In some implementations each fin 706 may be radially continuous across a base 708 of its respective fin insert. However, other implementations of the fins 706 may include segmented fins divided into plurality of sections, one or more ears formed via a V-shaped cut into the fin 706, etc. As depicted, each fin 706 has a rectangular cross-section and a trapezoidal profile, but other shapes may be used. For example, some or all of the fins 706 (across any portion of the inserts 702, 704) may comprise ovaloid cross-sections, a wave pattern cross-section etc. In some implementations, the slots in the beam spring in which the finned inserts 702, 704 are to be mounted may also be formed in the shape of the fins 706. Any other suitable geometry of the fins 706 that may handle large compressive loads when deployed downhole may be possible. While the fins 706 and slots are depicted as perpendicular to an axis of travel of the beam spring, other fin and slot configurations may be possible. For example, the fins 706 and corresponding slots on an example beam spring may be positioned diagonally to an axis of travel of the beam spring, some fin and slot configurations may be Z-shaped, etc. Other slot configurations and geometries may be possible.

Figure 8:
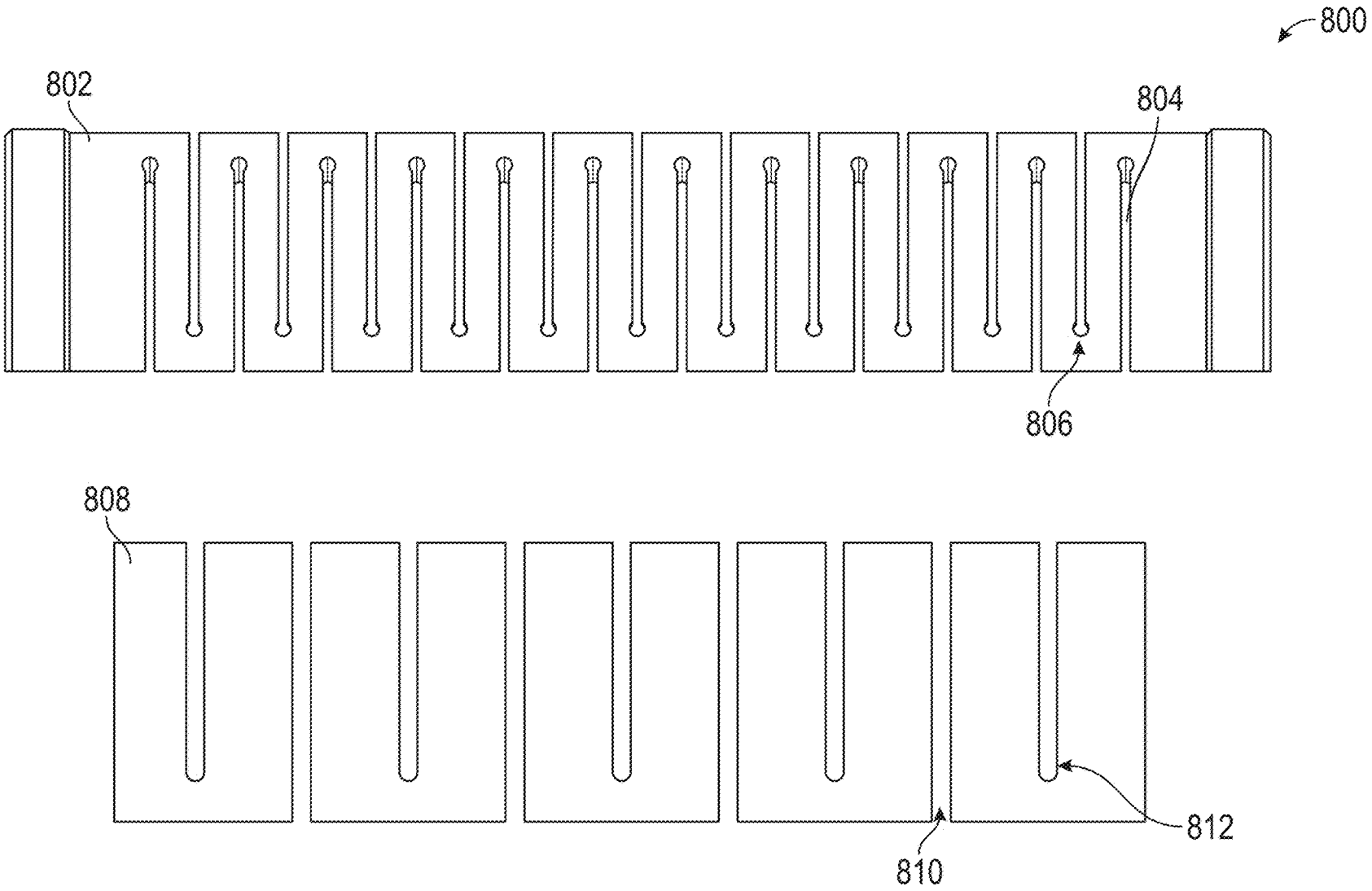
FIG. 8 is an illustration depicting traditional and current slot designs, according to some implementations.

FIG. 8 is an illustration 800 depicting traditional and current slot designs, according to some implementations. A traditional beam spring 802 may include a plurality of slots 804. The slots 804 may each include an opening to an exterior wall of the traditional beam spring 802 and a rounded end 806 with an enlarged radius when compared to the width of the slot 804.

A current beam spring 808 may use a plurality of slots 810 having a linear end 812. The linear ends 812 may not be tapered or enlarged. The beam spring 808 may be better configured to transfer an axial load to the above-described finned inserts than would slots with the rounded ends 806.

Figure 9:
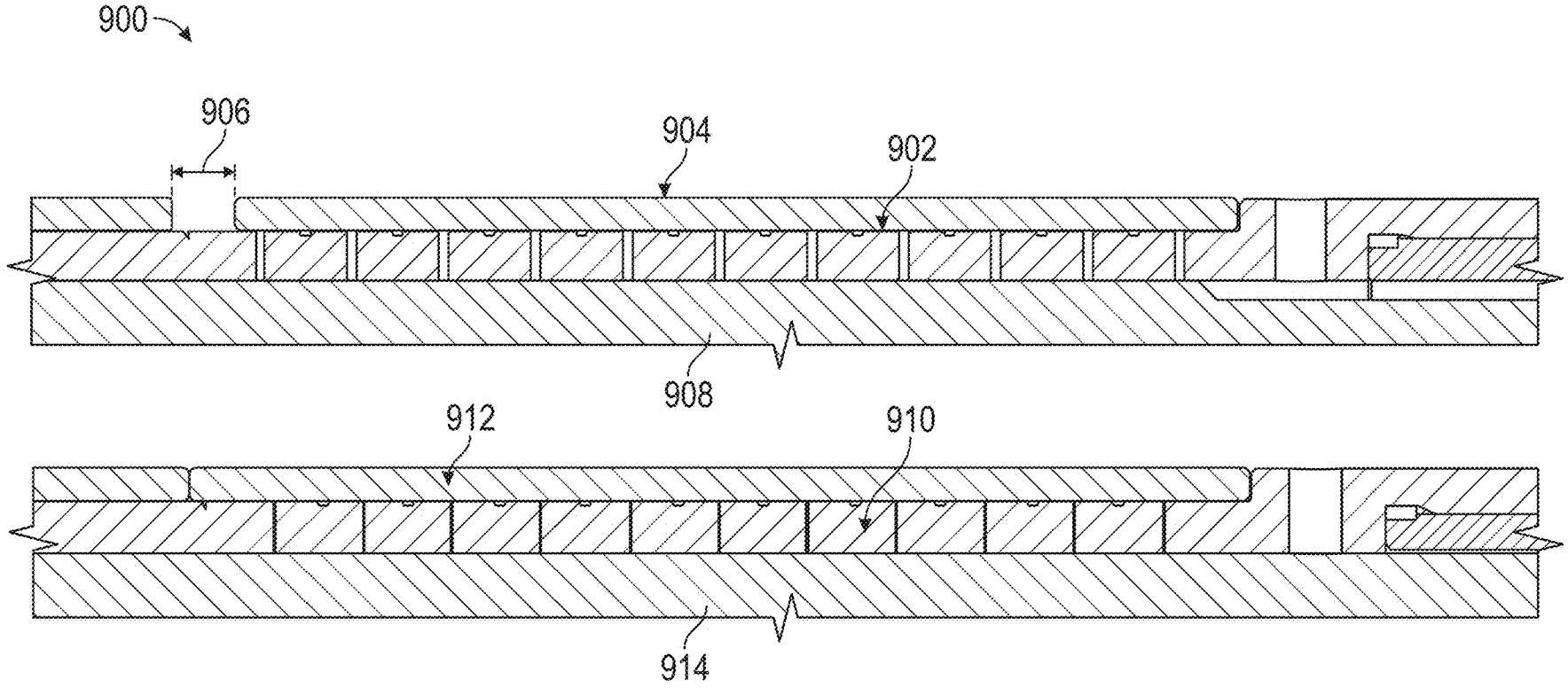
FIG. 9 is an illustration depicting a traditional sleeve for limiting the travel of an example beam spring.

A traditional external beam spring sleeve is now described. FIG. 9 is an illustration 900 depicting a traditional limiting sleeve for limiting the travel of an example beam spring. The illustration 900 includes a mandrel 908 and traditional beam spring 902. The traditional beam spring 902 may include a limiting sleeve 904. The limiting sleeve 904, also referred to as a compression sleeve, may be configured to limit a compression of the beam spring 902. For example, the beam spring 902 may be compressed to an allowable displacement 906. Once the beam spring has compressed to the allowable displacement 906, at least a portion of the axial load exerted on the beam spring 902 may transfer to the limiting sleeve 904. This is shown by the compressed limiting sleeve 912, used in conjunction with the mandrel 914 and beam spring 910.

Traditional travel limiting devices such as the limiting sleeve 904 may include several drawbacks. For example, the compressive load path may transfer from the beam spring 902 to the limiting sleeve 904 (or 912) when the gap formed by the allowable displacement 906 is closed. The limiting sleeve 904 may be comprised of a thick-walled material to handle the compressive load without buckling. For example, in the case of an internal limiting sleeve, the beam spring 902 may include thinner walls to accommodate the thick-walled inner sleeve. The wall thickness of the limiting sleeve 904, both in the internal sleeve and external sleeve configuration, may prove to be a limiting factor in traditional beam spring design. Additionally, external limiting sleeves such as the limiting sleeve 904 may induce problems during milling. In contrast, finned inserts such as the inserts 702 and 704 of FIG. 7 may include internal fins keyed into their respective slots. This may avoid the milling problems seen in traditional limiting sleeve configurations.

Example Operations

Figure 10:
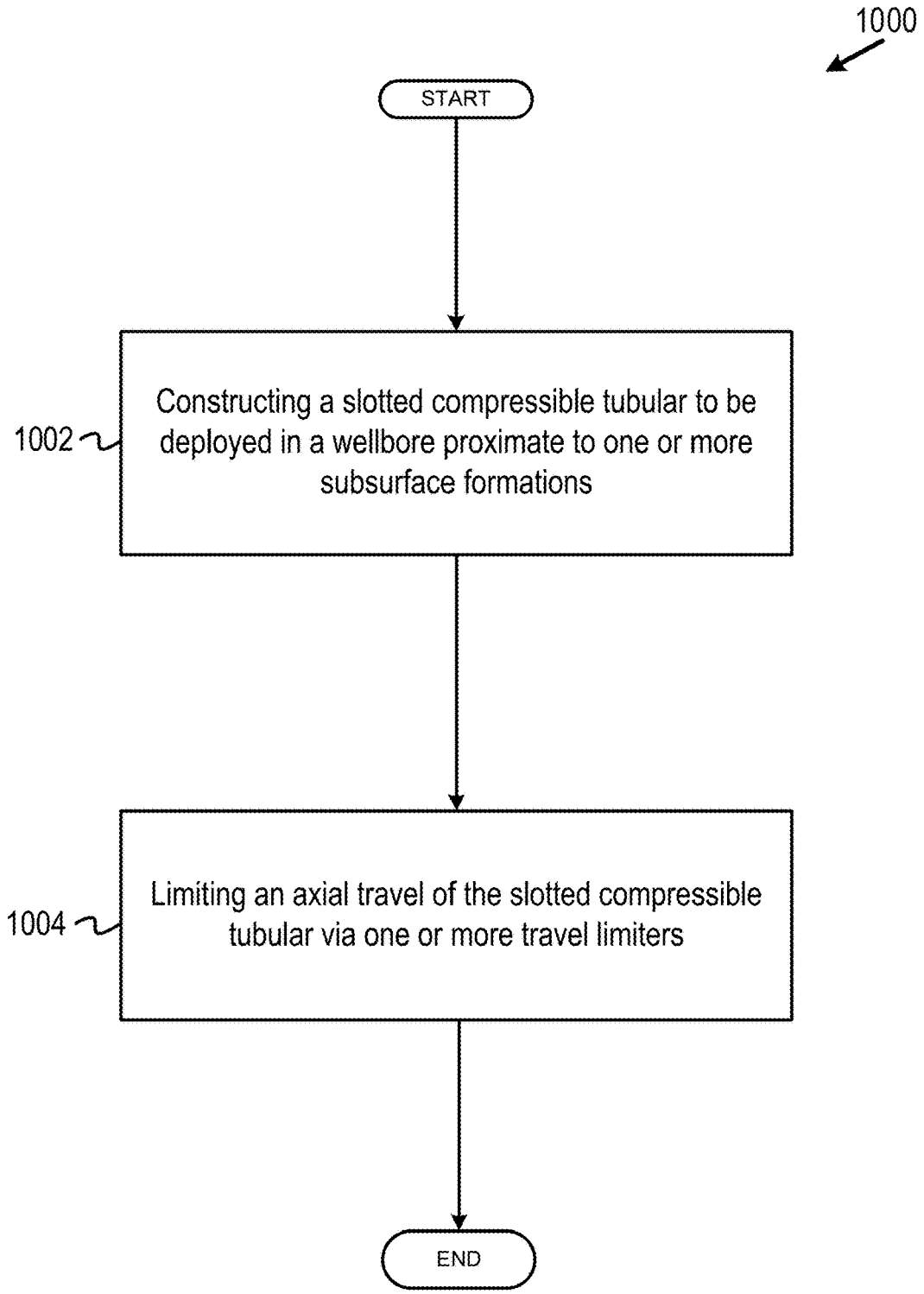
FIG. 10 is a flowchart depicting an example method of operations, according to some implementations.

Example operations for deploying a beam spring having a travel limiter are now described. FIG. 10 is a flowchart 1000 depicting an example method of operations, according to some implementations. Operations of the flowchart 1000 start at block 1002.

At block 1002, the method includes constructing a slotted compressible tubular to be deployed in a wellbore proximate to one or more subsurface formations. For example, a slotted compressible tubular such as the beam spring 204 may be created by machining, wire jetting, sawing, etc., a plurality of slots through the body of a tubular. The slots may be configured with various timings and spacings to give the tubular a degree of compressibility. The slotted compressible tubular, similar to the beam spring 110, may be deployed in the wellbore 100 proximate to the subsurface formation 118. The slotted compressible tubular may be used in place of traditional devices such as coil springs, Belleville washers, wave springs, etc. Flow progresses to block 1004.

At block 1004, the method includes limiting an axial travel of the slotted compressible tubular via one or more travel limiters. For example, one or more travel limiters such as the finned insert 406 may be configured to limit an axial travel of the beam spring 404. The finned insert 406 may include a thin tubular base and a plurality of fins 416 configured to minimize an impact to the strength of the beam spring 404 by axial loads.

Multiple finned inserts of various slot timings and phasings, such as the finned insert 702 and finned insert 704, may be positioned within at least a portion of the inner circumference of the beam spring 404. The fins 416 of the finned insert 406 may limit an axial travel of the beam spring 404 and avoid a compression of the beam spring 404 past its yield strength. The thickness of the fins may be optimized to achieve a desired amount of elastic compression in the beam spring. Flow of the flowchart 1000 ceases.

While the aspects of the disclosure are described with reference to various implementations and exploitations, it will be understood that these aspects are illustrative and that the scope of the claims is not limited to them. In general, techniques for creating and deploying a travel limiter to limit the travel of a beam spring under compression as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable sub-combination. Moreover, although features may be described as acting in certain combinations and even initially claimed as such, one or more features from a claimed combination may in some cases be excised from the combination, and the claimed combination may be directed to a sub-combination or variation of a sub-combination.

While operations are depicted in the drawings in a particular order, this should not be understood as requiring that such operations be performed in the order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well may be horizontal or even slightly directed upwards. Unless otherwise specified, use of the terms "subsurface formation" or "subterranean formation" shall be construed as encompassing both areas below exposed earth and areas below earth covered by water such as ocean or fresh water.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

Example Implementations

Implementation #1: An apparatus comprising: a finned insert configured for placement within at least a portion of an inner circumference of a slotted compressible tubular, the finned insert having a plurality of fins, wherein each fin of the plurality of fins is configured to fit within a slot of the slotted compressible tubular.

Implementation #2: The apparatus of Implementation 1, wherein the finned insert is configured to limit an axial travel of the slotted compressible tubular when subject to an axial compressive load.

Implementation #3: The apparatus of any one or more of Implementations 1-2, wherein the finned insert includes a curved base configured to fit within an interior portion of the slotted compressible tubular.

Implementation #4: The apparatus of any one or more of Implementations 1-3, wherein each fin of the plurality of fins is of a substantially identical thickness.

Implementation #5: The apparatus of any one or more of Implementations 1-4, wherein the plurality of fins are positioned perpendicular to an axis of travel of the slotted compressible tubular.

Implementation #6: A system comprising: a slotted compressible tubular configured for placement along a work string within a wellbore drilled through one or more subsurface formations; and a first travel limiter coupled with a first plurality of slots of the slotted compressible tubular, wherein the first travel limiter is positioned within at least a portion of an inner circumference of the slotted compressible tubular.

Implementation #7: The system of Implementation 6, further comprising: at least a second travel limiter coupled with a second plurality of slots of the slotted compressible tubular.

Implementation #8: The system of any one or more of Implementations 6-7, wherein the first travel limiter includes a first plurality of fins, wherein at least the second travel limiter includes a second plurality of fins.

Implementation #9: The system of any one or more of Implementations 6-8, wherein the first travel limiter is offset from the second travel limiter by a desired phasing.

Implementation #10: The system of any one or more of Implementations 6-9, wherein each slot of the first plurality of slots includes a gap width, wherein each fin of the first plurality of fins is configured to fit within each respective gap width of the first plurality of slots.

Implementation #11: The system of any one or more of Implementations 6-10, wherein each fin of the first plurality of fins is of a substantially identical thickness.

Implementation #12: The system of any one or more of Implementations 6-11, wherein the first travel limiter is configured to limit an axial travel of the slotted compressible tubular when subject to an axial compressive load, and wherein the limitation of the axial travel of the slotted compressible tubular via the first travel limiter prevents an overstress of the slotted compressible tubular in compression.

Implementation #13: The system of any one or more of Implementations 6-12, further comprising: an element package configured to form a pressure seal with an inner surface of a tubular positioned in the wellbore and the work string, wherein the element package shrinks during a temperature reduction in the wellbore; and a mechanical sealing device configured to form a mechanical seal with the inner surface of the tubular, wherein the slotted compressible tubular is configured to maintain at least one of the pressure seal and the mechanical seal via an application of axial load.

Implementation #14: The system of any one or more of Implementations 6-13, wherein the slotted compressible tubular is configured to reduce a backlash of the mechanical sealing device.

Implementation #15: A method comprising: constructing a slotted compressible tubular to be deployed in a wellbore proximate to one or more subsurface formations; and limiting an axial travel of the slotted compressible tubular via one or more travel limiters.

Implementation #16: The method of Implementation 15, wherein limiting the axial travel of the slotted compressible tubular via the one or more travel limiters prevents an overstress of the slotted compressible tubular in compression.

Implementation #17: The method of any one or more of Implementations 15-16, further comprising: creating a plurality of slots within a first tubular to form the slotted compressible tubular, wherein at least a first portion of the plurality of slots comprises a different timing than a second portion of the plurality of slots.

Implementation #18: The method of any one or more of Implementations 15-17, further comprising: positioning, within at least a portion of an inner circumference of the slotted compressible tubular, the one or more travel limiters, wherein the one or more travel limiters each include a plurality of fins configured to fit within the plurality of slots of the slotted compressible tubular.

Implementation #19: The method of any one or more of Implementations 15-18, further comprising: determining a maximum allowable axial displacement of the slotted compressible tubular based, at least in part, on a yield strength at a point on the slotted compressible tubular.

Implementation #20: The method of any one or more of Implementations 15-19, further comprising: determining a width of each of the plurality of fins based, at least in part, on the maximum allowable axial displacement of the slotted compressible tubular.

The invention claimed is:

1. An apparatus comprising:

a finned insert configured for placement within at least a portion of an inner surface of a slotted compressible tubular, the finned insert having a plurality of fins, wherein each fin of the plurality of fins is configured to fit within a slot of the slotted compressible tubular.

2. The apparatus of claim 1, wherein the finned insert is configured to limit an axial travel of the slotted compressible tubular when subject to an axial compressive load.

3. The apparatus of claim 1, wherein the finned insert includes a curved base configured to fit within an interior portion of the slotted compressible tubular.

4. The apparatus of claim 1, wherein each fin of the plurality of fins is of a substantially identical thickness.

5. The apparatus of claim 1, wherein the plurality of fins are positioned perpendicular to an axis of travel of the slotted compressible tubular.

6. A system comprising:

a slotted compressible tubular configured for placement along a pipe string within a wellbore drilled through one or more subsurface formations; and a first travel limiter to be positioned within a first plurality of slots of the slotted compressible tubular, wherein the first travel limiter is to be positioned within at least a portion of an inner surface of the slotted compressible tubular.

7. The system of claim 6, further comprising:

at least a second travel limiter coupled with a second plurality of slots of the slotted compressible tubular.

8. The system of claim 7, wherein the first travel limiter includes a first plurality of fins, wherein at least the second travel limiter includes a second plurality of fins.

9. The system of claim 8, wherein the first travel limiter is offset from the second travel limiter by a desired phasing.

10. The system of claim 8, wherein each slot of the first plurality of slots includes a gap width, wherein each fin of the first plurality of fins is configured to fit within each respective gap width of the first plurality of slots.

11. The system of claim 8, wherein each fin of the first plurality of fins is of a substantially identical thickness.

12. The system of claim 6, wherein the first travel limiter is configured to limit an axial travel of the slotted compressible tubular when subject to an axial compressive load, and wherein the limitation of the axial travel of the slotted compressible tubular via the first travel limiter prevents an overstress of the slotted compressible tubular in compression.

13. The system of claim 6, further comprising:

an element package configured to form a pressure seal between an inner surface of a tubular positioned in the wellbore and the pipe string, wherein the element package shrinks during a temperature reduction in the wellbore; and a mechanical sealing device configured to form a mechanical seal with the inner surface of the tubular, wherein the slotted compressible tubular is configured to maintain at least one of the pressure seal and the mechanical seal via an application of axial load.

14. The system of claim 13, wherein the slotted compressible tubular is configured to reduce a backlash of the mechanical sealing device.

15. A method comprising:

configuring one or more travel limiters to be positioned within a plurality of slots of a slotted compressible tubular, wherein the slotted compressible tubular is to be deployed in a wellbore proximate to one or more subsurface formations.

16. The method of claim 15, wherein the one or more travel limiters are configured to limit an axial travel of the slotted compressible tubular, and wherein limiting the axial travel of the slotted compressible tubular via the one or more travel limiters prevents an overstress of the slotted compressible tubular in compression.

17. The method of claim 15, further comprising:

creating the plurality of slots within a first tubular to form the slotted compressible tubular, wherein at least a first portion of the plurality of slots comprises a different timing than a second portion of the plurality of slots.

18. The method of claim 17, further comprising:

positioning the one or more travel limiters within an inner surface of the slotted compressible tubular, wherein the one or more travel limiters each include a plurality of fins configured to fit within the plurality of slots of the slotted compressible tubular.

19. The method of claim 18, further comprising:

determining a maximum allowable axial displacement of the slotted compressible tubular based, at least in part, on a yield strength at a point on the slotted compressible tubular.

20. The method of claim 19, further comprising:

determining a width of each of the plurality of fins based, at least in part, on the maximum allowable axial displacement of the slotted compressible tubular.

* * * * *